US010750851B2

(12) United States Patent
Mikitovic

(10) Patent No.: US 10,750,851 B2
(45) Date of Patent: Aug. 25, 2020

(54) HAIR BRUSH

(71) Applicant: Conair Corporation, Stamford, CT (US)

(72) Inventor: Jessica Anna Mikitovic, New Rochelle, NY (US)

(73) Assignee: Conair Corporation, Stamford, CT (US)

( * ) Notice: Subject to any disclaimer, the term of this patent is extended or adjusted under 35 U.S.C. 154(b) by 57 days.

(21) Appl. No.: 15/672,803

(22) Filed: Aug. 9, 2017

(65) Prior Publication Data

US 2019/0045911 A1 Feb. 14, 2019

(51) Int. Cl.

*A46B 9/02* (2006.01)
*A46B 1/00* (2006.01)
*A46B 5/02* (2006.01)

(52) U.S. Cl.

CPC ..... *A46B 9/02* (2013.01); *A46B 1/00* (2013.01); *A46B 9/023* (2013.01); *A46B 5/021* (2013.01); *A46B 2200/104* (2013.01)

(58) Field of Classification Search

CPC .... A46D 1/0246; A46D 20/48; A46D 1/0284; A45D 20/48; A45D 20/50; A45D 20/52; A45D 20/525; A46B 9/023; A46B 2200/104; A46B 9/02; A46B 9/025

USPC ..... 132/228, 271, 122, 142, 159, 901, 148; 15/186, 187, 207.2

See application file for complete search history.

(56) References Cited

U.S. PATENT DOCUMENTS 5,657,775 A * 8/1997 Chou ..... A46B 7/04 132/125
2015/0069263 A1* 3/2015 Moyal ..... A61L 2/10 250/455.11

OTHER PUBLICATIONS

Amazon, Olivia Garden NT-54 NanoThermic Ceramic + Ion Round Thermal Hair Brush, 2009 https://www.amazon.com/Olivia-Garden-NT-54-NanoThermic-Ceramic/dp/B003IX36H0/ref=cm_cr_arp_d_product_top?ie=UTF8&th=1 (Year: 2009).*

Amazon, Olivia Garden NT-54 Nano Thermic Ceramic + Iron Round Thermal Hair Brush, 2012 https://www.amazon.com/Olivia-Garden_NT_54_NanoThermic-Ceramic/dp/B003IX36H0/ref=cm_cr_arp_d_product_top?ie=UTF8&th=1 (Year: 2012).*

* cited by examiner

*Primary Examiner* — Monica S Carter
*Assistant Examiner* — Abbie E Quann
(74) *Attorney, Agent, or Firm* — Ohlandt, Greeley, Ruggiero & Perle, L.L.P.

(57) ABSTRACT

A hair brush that has a circular head or bristle portion with a circular hollow support member that has apertures that accommodate first and second bristles. Each bristle has a triangular hollow shape so that when positioned through the apertures, air can flow through (a) the hollow in the triangular bristles, (b) the apertures in the support member, and (c) outward through a non-bristle side of the support member.

16 Claims, 9 Drawing Sheets

HAIR BRUSH

BACKGROUND OF THE DISCLOSURE

1. Field of the Disclosure

The present disclosure relates generally to a hair brush having an improved bristle configuration. More particularly, the present disclosure relates to a circular hair brush having alternating patterns of hollow, preferably triangular bristles to separate and spread the hair and simultaneously direct unwanted and/or unnecessary hot air away from the hair.

2. Description of Related Art

Professional hairstylists worldwide routinely employ a set of tools for shaping and styling hair. Among these are hair brushes and hand-held, electrically-heated "hairdryers", also known as "blow dryers". A hair brush has a plurality of bristles in different rows or in different columns that are usually oriented in a parallel direction. This configuration causes the hair not to be separated and spread when the brush is pulled though the hair. Further, the hair brush manipulates the hair as a flow of heated air generated by the hairdryer assists in setting the shape of the individual's hair. To style hair in a particular shape, many people blow hot air to dry their hair as they brush it. While simultaneously blow drying and brushing the hair, heat, such as in the form of hot air, is applied directly to the hair, and thus the hot air pushes against the hair during blowing. The unwanted hot air can sometimes even deform the hair that has been shaped and styled. Also, the unnecessary hot air can cause discomfort for some individuals.

Accordingly, there is a need for a hair brush to separate and spread the hair and simultaneously direct unwanted and/or unnecessary hot air from the hairdryers.

SUMMARY

The present disclosure provides a hair brush that has a circular head or bristle portion with a circular hollow support member that has a plurality of apertures that accommodate a plurality of first and second bristles with each bristle having a hollow so that when positioned through the apertures, air can flow through (a) the hollow in the bristles, (b) the apertures in the support member, and (c) outward through a non-bristle side of the support member.

The present disclosure also provides a hair brush having a head with alternating patterns of hollow triangular-shaped bristles that result in alternating flat and tapered profiles that cause the hair to intermittently be separated and spread when the hair brush is pulled through the hair.

The present disclosure further provides such a hair brush in which the hollows of the triangular bristles allow heated air from an air source, such as a hair dryer, applied to the hair brush and hair, to pass through the bristle and support member and, thus, away from the hair brush.

The present disclosure still further provides that the plurality of the first and second bristles each form a triangular hollow shape with two round legs that form a triangular opening between two legs and the support member of the brush head.

The present disclosure also provides such a hair brush that the first row of the plurality of second bristles is separated from the adjacent second row of the first bristles by a first constant distance, and each adjacent pairs of bristles in each row are separated from each other along the longitudinal axis by a second constant distance. In the most preferred embodiment, the first and second constant distances are the same distance.

The above-described and other advantages and features of the present disclosure will be appreciated and understood by those skilled in the art from the following detailed description, drawings and appended claims.

BRIEF DESCRIPTION OF THE DRAWINGS

In the description of the embodiment below, the components referenced by the same numbers perform the same operations throughout the embodiment, and repetitive descriptions will be omitted for brevity.

DETAILED DESCRIPTION OF THE DISCLOSURE

Figure 1:
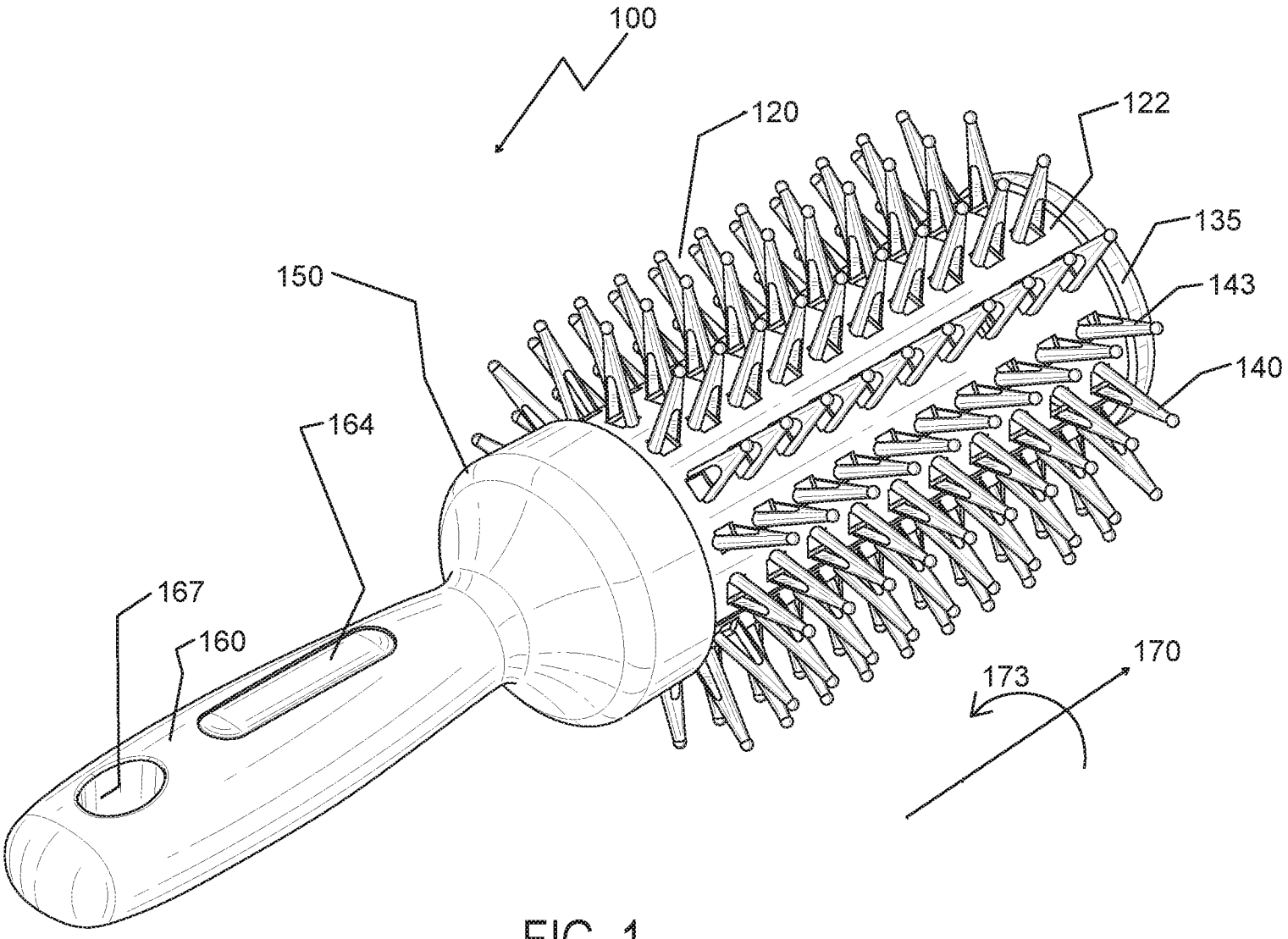
FIG. 1 is a top, back perspective view of the hair brush of the present disclosure.

Referring to the drawings and, in particular, to FIG. 1, the present disclosure relates to a circular hair brush generally represented by reference numeral 100. Hair brush 100 has a head portion 120, a handle or handle portion 160, and a connector portion 150 to connect the head portion 120 to the handle portion 160.

Figure 2:
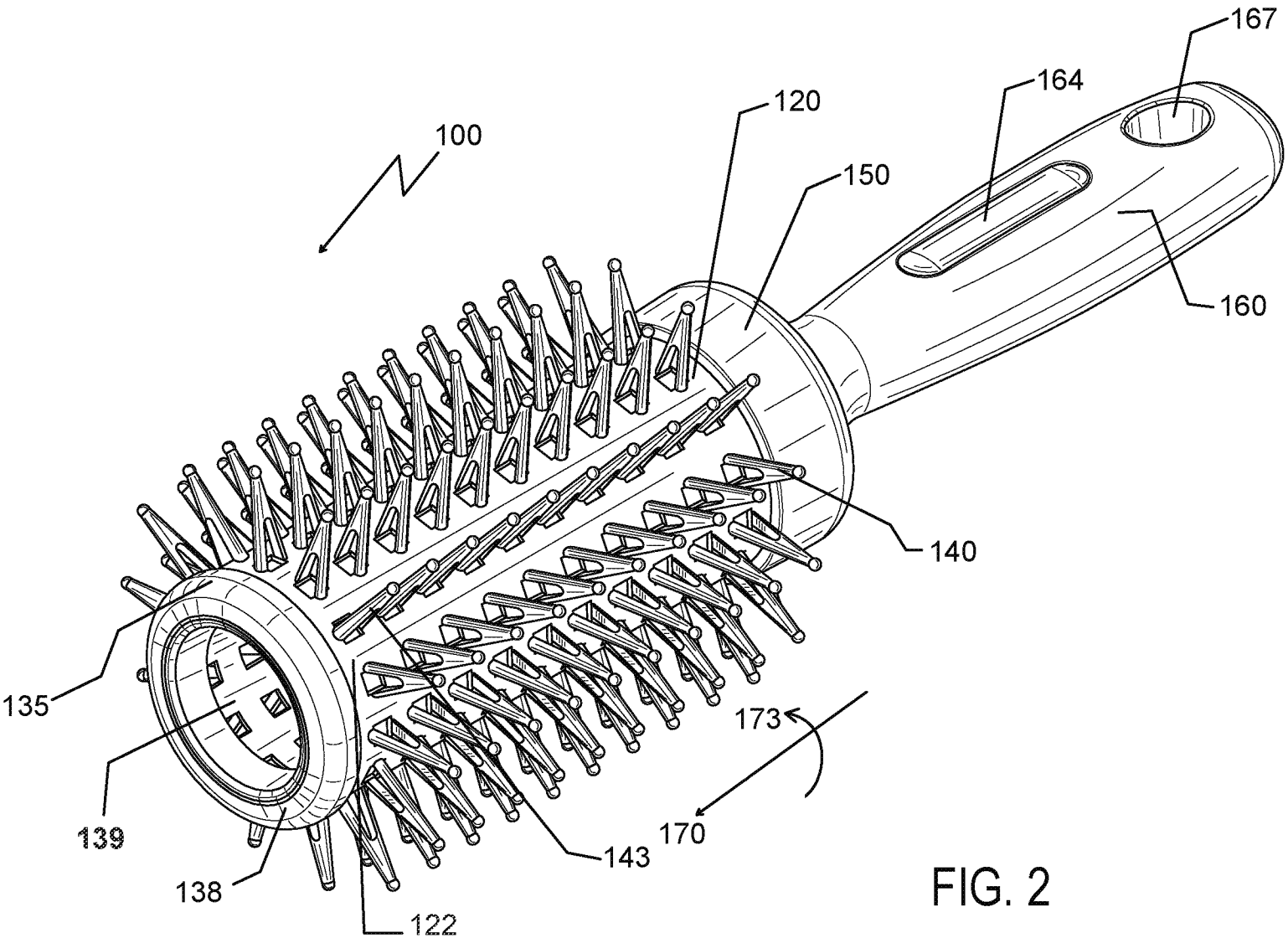
FIG. 2 is a top, front perspective view of the hair brush of FIG. 1.

Referring to FIG. 2, head portion 120 has a rounded shape, hollow support member 122 with a rear portion 135 that is connected to the support member. Rear portion 135 preferably has a cushion member 138 shown in FIG. 2 for comfort when the user stokes his/her hair.

Figure 3:
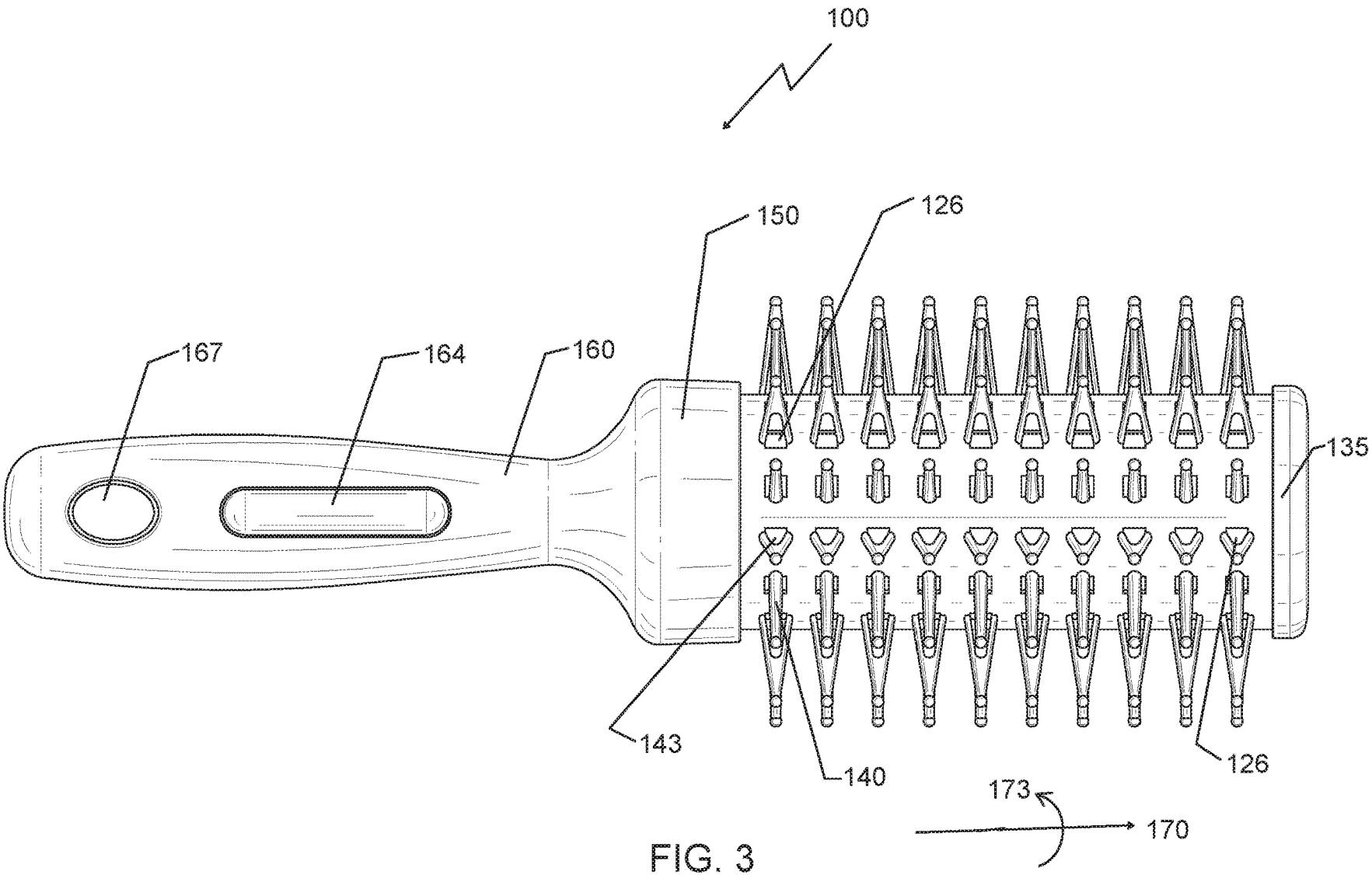
FIG. 3 is a top view of the hair brush of FIG. 1

Referring to FIG. 3, support member 122 has a plurality of apertures 126 that accommodate a plurality of first bristles 140 and second bristles 143. Bristles 140, 143 each project outward from support member 122 to form a round profile.

Each of the plurality of apertures 126 of support member 122 has the same shape. As shown in FIGS. 1 to 3 embodiment, each aperture 126 has a rectangular shape.

Figure 4:
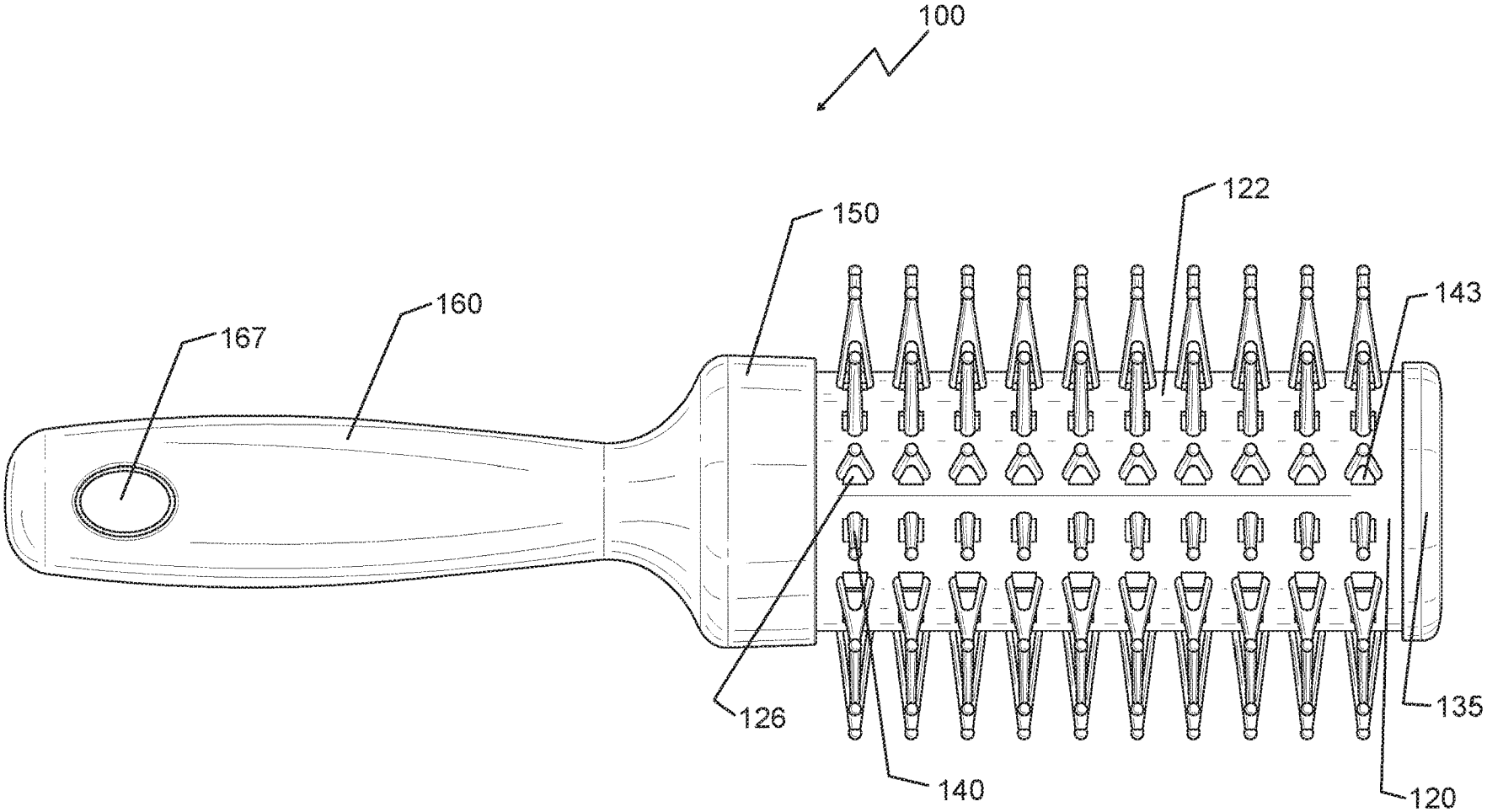
FIG. 4 is a bottom view of the hair brush of FIG. 1.
Figure 5:
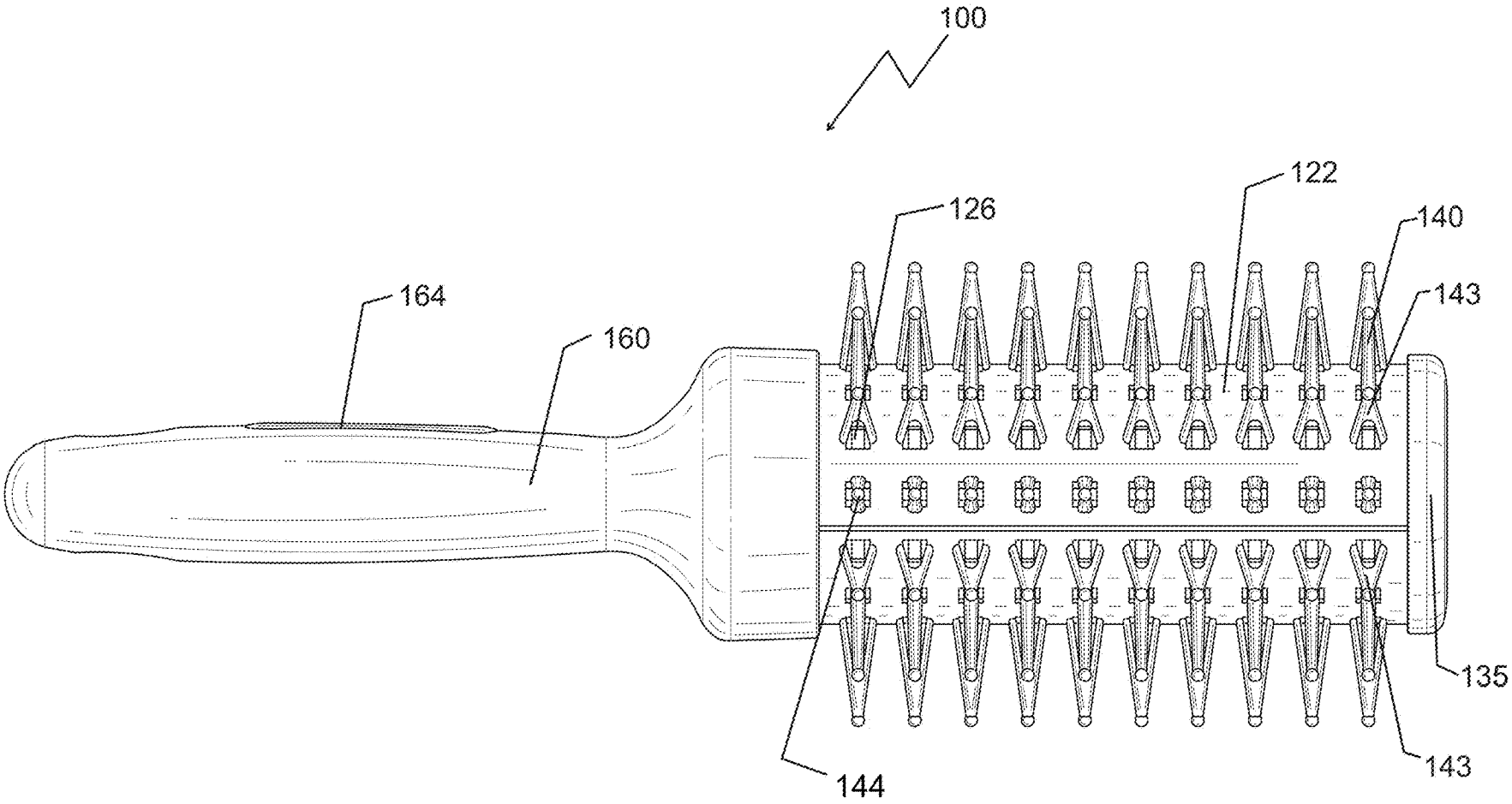
FIG. 5 is a front plan view of the hair brush of FIG. 1.

Referring to FIGS. 3 to 5, apertures 126 of support member 122 assist in forwarding air away from hair brush 100. This air flow that is away from hair brush 100 is further enhanced by the shape and construction of the bristles 140 and 143, as discussed below.

The handle or handle portion 160 has an opening 167 through the handle. Opening 167 can be used to secure the hair brush 100 on a hook. The handle or handle portion 160 has a slot 164. The slot 164 is preferably an elongated horizontal to decrease the weight of handle 160.

Figure 6:
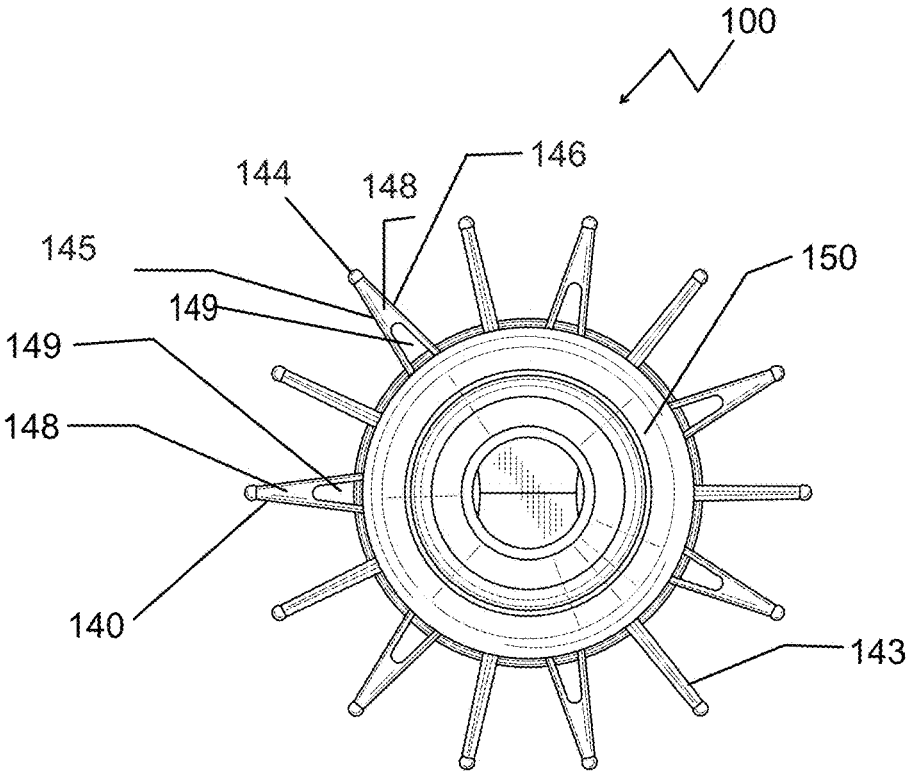
FIG. 6 is a first end view of the hair bush of FIG. 1.

Referring to FIG. 6, each bristle of the plurality of first bristles 140 and the second bristles 143 has a round head 144, a pair of outer ribs 145, 146 and an inner fin or rib 148

The inner fin 148 along with outer ribs 145, 146 and support member 122 form an opening or aperture 149. To assist in retaining the shape of each bristle 142, inner fin 148 has an accurate shaped portion to maintain the integrity of outer ribs 145, 146. Thus, each bristle 140, 143 has a triangular shape, and in the embodiment shown in FIGS. 1-7, a round head 144, two outer ribs 145, 146, and an inner rib 148 that connects the head and the two outer ribs together form aperture 149.

The plurality of first bristles 140 are disposed in alternating rows along a longitudinal axis 170 shown in FIG. 1. Further, a plurality of second bristles 143 is disposed in alternating rows along the longitudinal axis 170 with one row of bristles 143 between an adjacent pair of rows of bristles 140.

As shown in FIGS. 1-3 and 6 and 7, bristles 140 are about or at a ninety-degree (90°) angle with respect to second bristles 143. This configuration results in first bristles 140 and second bristles 143 being disposed alternately in a first column that curves along a latitudinal axis 173 as shown in FIG. 3. The configuration of first bristles 140 and second bristles 143 in alternating rows along a longitudinal axis of the head of the hair brush and each adjacent row of bristles positioned perpendicular or 90 degrees with respect to the adjacent row results in successive bristles being orthogonal with respect to each other. This orthogonal structure provides intermittent separation and spreading when the hair brush is pulled through the hair.

Each adjacent pair of apertures 126 in the first and second rows has a first distance therebetween. Likewise, each adjacent pairs of apertures 126 in the first and second columns (again perpendicular or virtually perpendicular to a row) has a second distance therebetween. Thus, each bristle 140, 143 in each row and column are separated by these constant first and second distances. Preferably, the first and second distances are the same.

As shown clearly in FIGS. 1-7, all first bristles 140 in one row are positioned in the same direction or in a direction 90 degrees with respect to all second bristles 143 in the adjacent rows. Again, by this pattern, which is an alternating pattern, successive bristles 140, 143 are oriented orthogonally with respect to each other, as noted above, to create an alternating flat and taped profile as shown in FIGS. 1-5. Again by this profile, hair is both separated and spread intermittently when brush 100 is combed or pulled through a user's hair.

Figure 7:
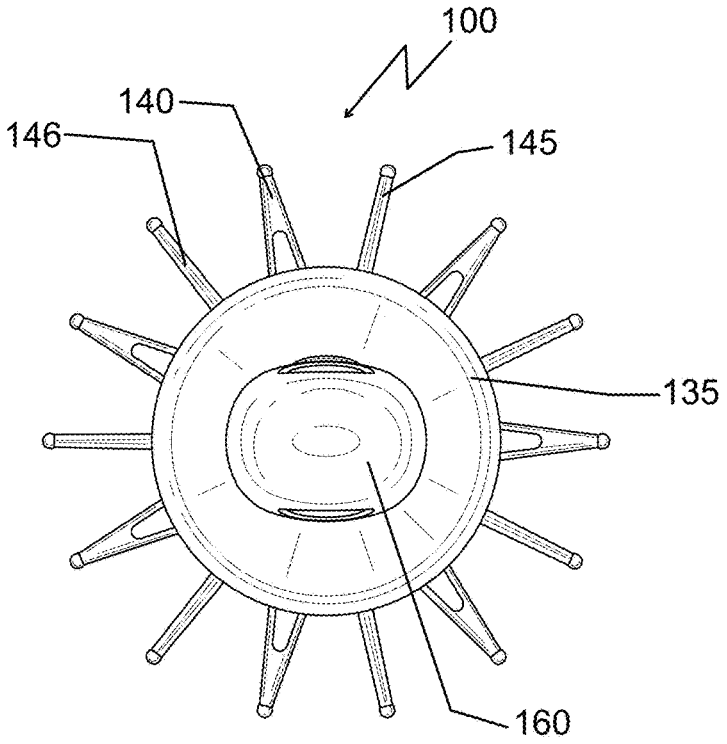
FIG. 7 is a second end view opposite the first end view of the hair bush of FIG. 1.

Further, as shown in FIGS. 6 and 7, each bristle of first bristles 140 and second bristles 143 with outer ribs 145, 146 that extend outward from head 144 and opening aperture 149 creates a hollow channel 139 shown in FIG. 2 through support member 126 as shown more clearly in FIG. 6. By this structure, when air is directed to first bristles 140 and second bristles 143, the air will pass through apertures 126 and be directed to hollow channel 139, again shown in FIG. 2, and into the ambient environment away from hair brush 100. Similarly, should air be directed or forced into hollow channel 139, the air will go through apertures 126 to first bristles 140 and second bristles 143 and thus the hair of the user of the hair brush 100. This may be used to direct heated air to the precise area where the bristles contact the user's hair in order to assist in setting the shape of the hair.

As shown in FIGS. 1 to 3, in one embodiment, head portion 120, connector portion 150 and handle 160 can be formed as one piece, or any combination of two parts can be formed as one piece provided connected to the third piece. In another embodiment, handle 160 can have a rear portion and a front portion that are connected together and can be detachable. Likewise, head portion 120 can be made of two or more pieces that are connected together and detachable. The formation of the hair brush 100 in separate pieces that are connected together can assist in placing hollows in the hair brush to lighten the weight of the hair brush.

Figure 8:
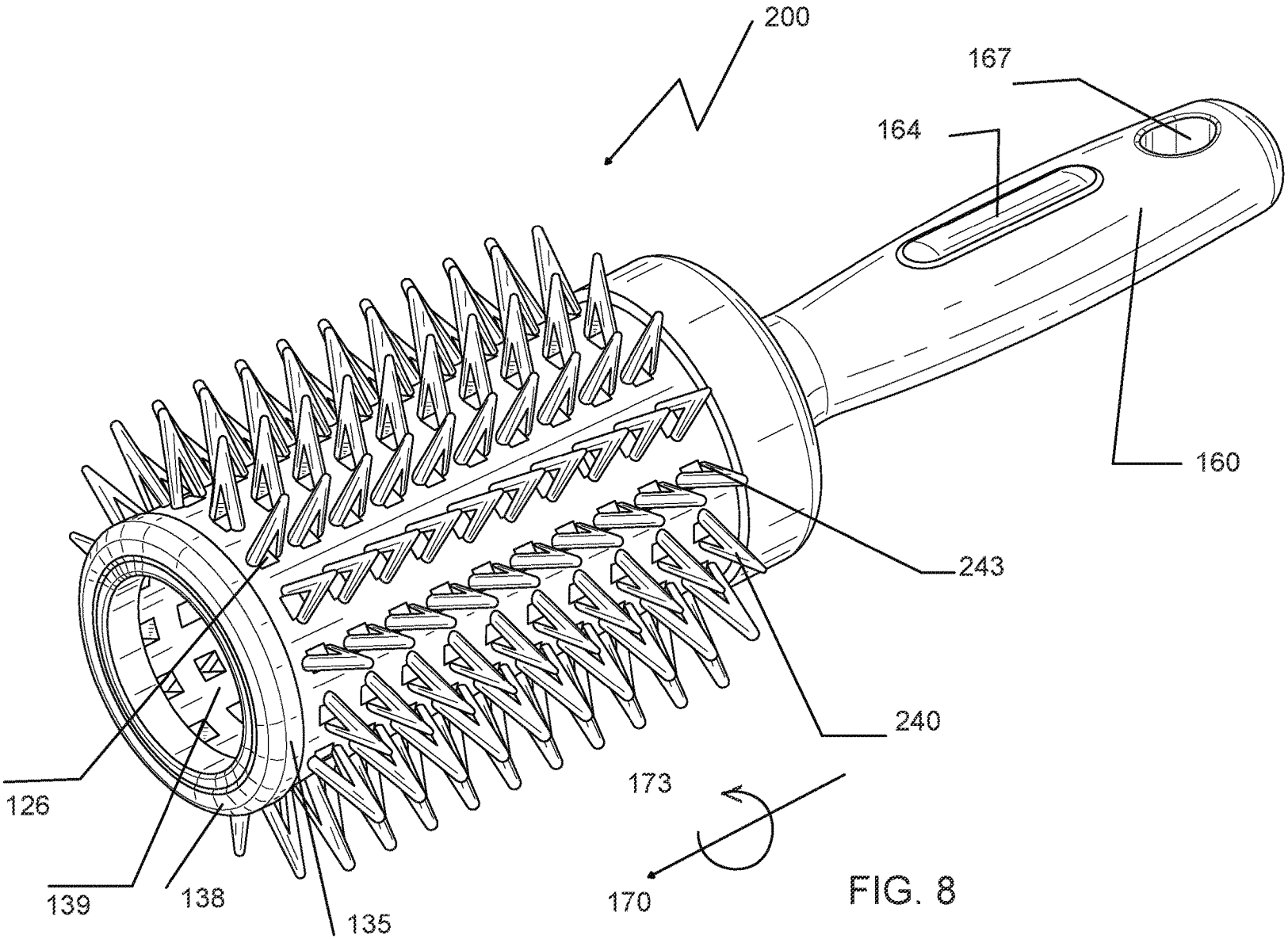
FIG. 8 is a top, front perspective view of the hair brush of the present disclosure.
Figure 9:
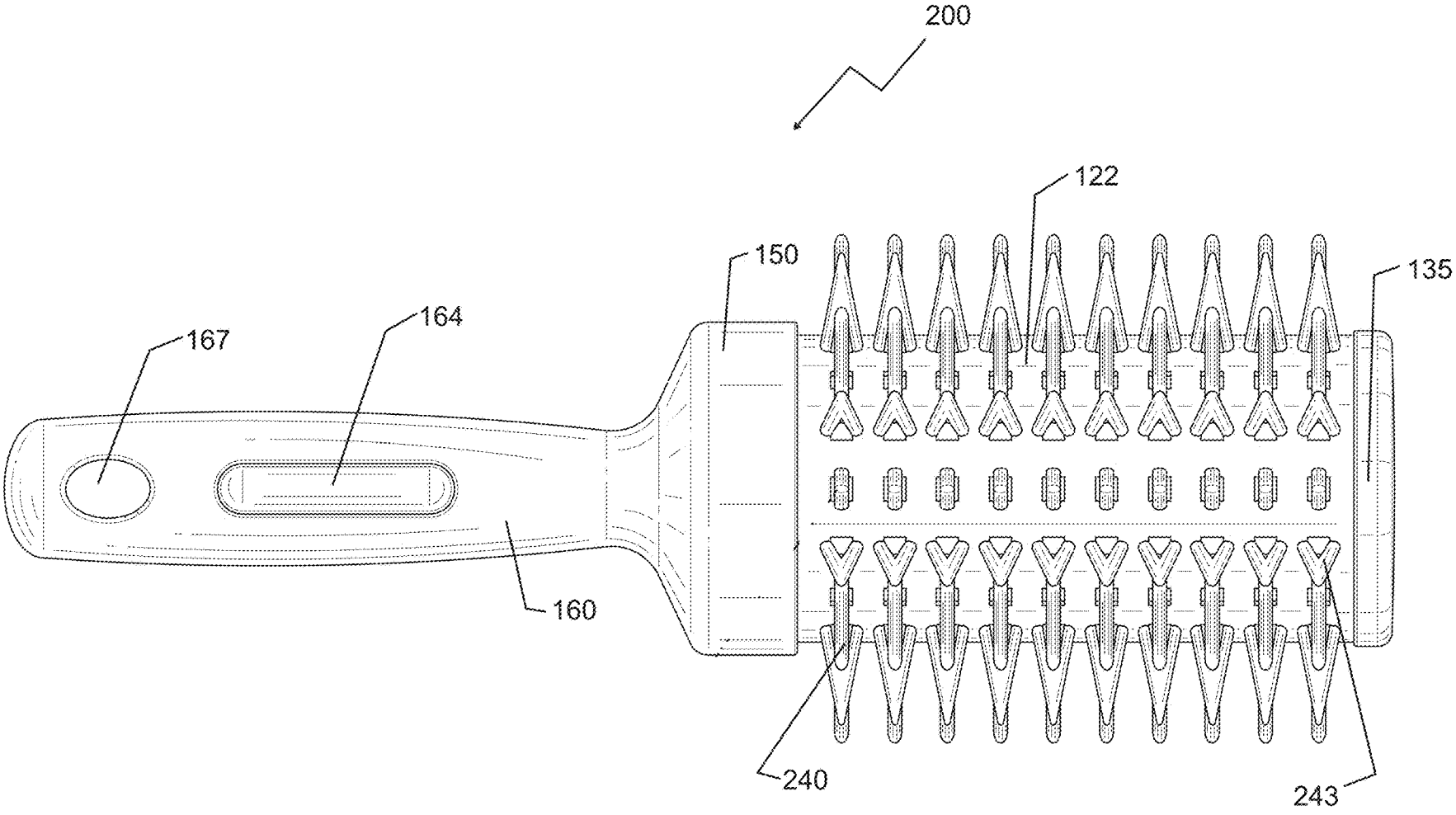
FIG. 9 is a top view of the hair brush of FIG. 8.
Figure 10:
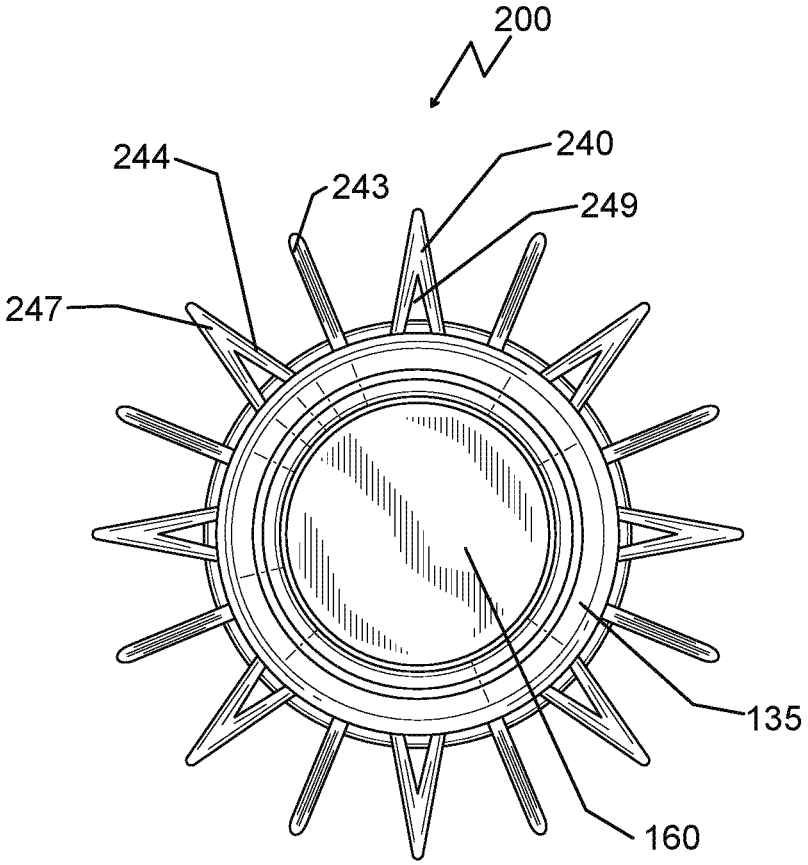
FIG. 10 is an end view of the hair bush of FIG. 8.

Referring to FIGS. 8-10, in a second embodiment, the components referenced by the same numbers of a hair brush 200 perform the same operations throughout the embodiment, and repetitive descriptions will be omitted for brevity. The construction of hair brush 200 is the same as hair brush 100, except for the bristle construction discussed below.

In this second embodiment, a plurality of first bristles 240 and a plurality of second bristles 243 are disposed alternatively in adjacent rows and as in the first embodiment. However, unlike the first embodiment, each bristle of the plurality of first bristles 240 and second bristles 243 has a different construction than that of first and second bristles 140, 143 of the first embodiment. Specifically, each bristle 240, 243 has two round legs 244 that form a triangular frame 247 and a triangular opening 249. With this structure, as with the structure of bristles 140. 143 of the first embodiment, when air comes across first bristles 240 and second bristles 243, the air will pass through apertures 126 and be directed to the ambient environment through hollow channel 139 as shown in FIGS. 8 and 9. Similarly, when an air is directed into hollow channel 139, the air will go through apertures 126 and is then directed to first bristles 140 and second bristles 143.

Bristles 240, 243 of the second embodiment, like bristles 140, 143 of the first embodiment, has alternating rows and the exact or virtually ninety-degree pattern that results in an orthogonal configuration that separates and intermittently spreads hair being combed by the hair brush. Further by the bristle construction and the circular-hollow shaped support surface 122, when air is applied to the bristles, air is moved into the hollow of the support member and away from the bristles of the hair brush thereby minimizing heat from air on the hair of the user of the hair brush.

It should be noted that the terms "first", "second", "third", and the like may be used herein to modify various elements. These modifiers do not imply a spatial, sequential or hierarchical order to the modified elements unless specifically stated.

While the present disclosure has been described referring to one or more exemplary embodiments, it will be understood by those skilled in the art that various changes can be made and equivalents can be substituted for elements thereof without departing from the scope of the present disclosure. In addition, modifications can be made to adapt a particular situation or material to the teachings of the present disclosure without departing from the scope thereof. Therefore, it is intended that the present disclosure will not be limited to the particular embodiment(s) disclosed as the best mode contemplated, but that the present disclosure will include all embodiments falling within the scope of the appended claims.

What is claimed is:

1. A hair brush comprising:

a head formed into a circular shape to create a hollow channel, the head comprising a support member having a plurality of apertures for receiving a plurality of bristles, the plurality of bristles having a hollow portion contiguous with the plurality of apertures and projecting away from the hollow channel of the head so that air directed onto the plurality of bristles can flow through the hollow portion and the plurality of apertures and into the hollow channel away from a user of the hair brush, each bristle of the plurality of bristles having a triangular shape with a pair of outer ribs with straight edges forming sidewalls and a rib forming a base edge connecting the sidewalls, the head having a longitudinal axis so that the plurality of bristles are positioned in longitudinal rows, a first row of the longitudinal rows having each of the base edges oriented parallel to the longitudinal axis, a second row of the longitudinal rows being adjacent to the first row, the second row having each of the base edges oriented orthogonally to the base edges of the first row.

2. The hair brush of claim 1, wherein the first row and the second row each have bristles of the plurality of bristles that project outward from the support member to form a circular configuration.

3. The hair brush of claim 1, wherein the plurality of apertures each has a rectangular or square shape.

4. The hair brush of claim 1, wherein the plurality of bristles includes first and second bristles each having the hollow portion so that when positioned through the plurality of apertures, an air flows (a) through the hollow portion of the first and second bristles, (b) through the plurality of apertures, and (c) outward through the hollow channel of the head to stay away from hair of a user.

5. The hair brush of claim 4, wherein the triangular shape allows heated air from an air source applied to the hair brush to pass through to the hollow channel of the head.

6. The hair brush of claim 1, wherein the plurality of bristles includes first and second bristles that each form the triangular shape, wherein the triangular shape has a round head, and wherein the round head, the pair of outer ribs, and the base edge that connects the round head and the pair of outer ribs together forms the hollow portion between the pair of outer ribs and the support member of the head of the hair brush.

7. The hair brush of claim 1, wherein the first row has first bristles of the plurality of bristles that are formed into alternating rows, and the second row has second bristles of the plurality of bristles that are also formed into alternating rows that intermit with the alternating rows of first bristles disposed about ninety degrees with respect to the second bristles to create an orthogonal pattern for easy of spreading and intermittent separation of brushed hair.

8. The hair brush of claim 7, wherein each of the first bristles of the first row is separated from an adjacent one of the second bristles of the second row by a first constant distance.

9. The hair brush of claim 8, wherein each adjacent pair of first bristles are separated from each other along a longitudinal axis by a second constant distance.

10. The hair brush of claim 9, wherein each adjacent pair of second bristles are separated from each other along the longitudinal axis by the second constant distance.

11. The hair brush of claim 7, wherein the first row and the second row form a plurality of columns along a latitudinal axis of the head, and wherein the first row and the second row are formed into alternating columns and are parallel with respect to each other.

12. The hair brush of claim 11, wherein the first row is separated from the second row by a third constant distance.

13. The hair brush of claim 1, further comprising a hollow handle.

14. The hair brush of claim 13, wherein the hollow handle comprises a horizontal slot in the handle.

15. The hair brush of claim 13, further comprising a connector to connect the head to the handle.

16. The hair brush of claim 15, wherein the head and the handle are detachable.

* * * * *